US007260346B2

(12) United States Patent
Himes

(10) Patent No.: US 7,260,346 B2
(45) Date of Patent: Aug. 21, 2007

(54) DEVELOPER CARTRIDGE WITH A GEOMETRY CONFIGURED TO OPEN AND CLOSE A SHUTTER

(76) Inventor: William D. Himes, 4752 Schooner Blvd., Suffolk, VA (US) 23425

( * ) Notice: Subject to any disclaimer, the term of this patent is extended or adjusted under 35 U.S.C. 154(b) by 159 days.

(21) Appl. No.: 11/133,293

(22) Filed: May 20, 2005

(65) Prior Publication Data

US 2005/0265753 A1 Dec. 1, 2005

Related U.S. Application Data

(60) Provisional application No. 60/573,379, filed on May 24, 2004.

(51) Int. Cl.
*G03G 15/08* (2006.01)

(52) U.S. Cl. ..... 399/262; 399/263

(58) Field of Classification Search ..... 399/262, 399/263, 258, 256, 260, 119, 120; 222/DIG. 1; 366/279, 285

See application file for complete search history.

(56) References Cited

U.S. PATENT DOCUMENTS

| | | | | |
|---|---|---|---|---|
| 5,489,976 | A * | 2/1996 | Ichikawa | 399/263 |
| 5,579,101 | A | 11/1996 | Omata et al. | 399/114 |
| 5,870,652 | A * | 2/1999 | Kanamori et al. | 399/106 |
| 6,131,007 | A | 10/2000 | Yamaguchi et al. | 399/256 |
| 6,131,008 | A | 10/2000 | Kanamori et al. | 399/263 |
| 6,229,976 | B1 | 5/2001 | Kimura | 399/262 |
| 6,266,506 | B1 | 7/2001 | Kurz et al. | 399/262 |
| RE37,542 | E * | 2/2002 | Ichikawa et al. | 399/263 |
| 6,459,876 | B1 * | 10/2002 | Buchanan et al. | 399/263 X |
| 6,654,569 | B2 * | 11/2003 | Nozawa | 399/262 X |
| 2002/0021909 | A1 * | 2/2002 | Harumoto | 399/27 |
| 2002/0122676 | A1 * | 9/2002 | Yamada et al. | 399/263 |
| 2002/0150410 | A1 * | 10/2002 | Matsuda et al. | 399/263 |
| 2004/0101331 | A1 | 5/2004 | Himes | 399/262 |
| 2005/0135841 | A1 * | 6/2005 | Murakami et al. | 399/258 |
| 2005/0135842 | A1 * | 6/2005 | Murakami et al. | 399/262 |
| 2005/0196197 | A1 * | 9/2005 | Himes | 399/262 |
| 2005/0196200 | A1 * | 9/2005 | Himes | 399/262 |

FOREIGN PATENT DOCUMENTS

| | | | |
|---|---|---|---|
| JP | 59-206849 A | * | 11/1984 |
| JP | 62-086382 | | 4/1987 |
| JP | 62-170987 | | 7/1987 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A developer cartridge includes a body member configured to store a developer. The body member defines a developer delivery opening configured to deliver the stored developer to an exterior of the body member, the body member defining first and second open ends. A first flange member is disposed in the first open end. A second flange member is disposed in the second open end. A lug is aligned with an extension of the developer delivery opening. The lug is configured to open and to close a shutter of an image forming apparatus in which the developer cartridge is installed.

15 Claims, 12 Drawing Sheets

DEVELOPER CARTRIDGE WITH A GEOMETRY CONFIGURED TO OPEN AND CLOSE A SHUTTER

CROSS-REFERENCE TO RELATED APPLICATION

This application claims priority to U.S. provisional application No. 60/573,379, filed on May 24, 2004, the disclosure of which is incorporated by reference herein in its entirety.

BACKGROUND OF THE INVENTION

1. Field of the Invention

The present invention relates to a developer cartridge for an image forming apparatus.

2. Description of the Related Art

In a known image forming apparatus, such as a facsimile machine, a photocopying machine, a printer, and the like, toner is consumed during multiple image forming processes to form toner images on recording sheets. A known toner cartridge (e.g., a first toner cartridge) is inserted into the image forming apparatus. The toner cartridge is manually rotated in a first direction, such that a first projection on the toner cartridge contacts and displaces a corresponding portion of a shutter to thereby open the shutter. The manual rotation also aligns an opening of the toner cartridge with the opening of the image forming apparatus. During the image forming processes, toner is delivered from the toner cartridge to the opening of the image forming apparatus and is consumed to form the images on the sheets.

Eventually, the toner is fully exhausted from the first toner cartridge. The toner cartridge is manually rotated in a second direction, which is opposite to the first direction, such that a second projection of the toner cartridge contacts and displaces a different corresponding portion of the shutter to thereby close the shutter. The exhausted first toner cartridge is removed from the image forming apparatus, and a second toner cartridge, which includes toner, is then inserted into the image forming apparatus.

The known toner cartridge suffers from a number of disadvantages. Because separate, multiple projections are required (i.e., the first projection to open the shutter of the image forming apparatus and the second projection to close the shutter), manufacture of the known toner cartridge is complicated. Thus, manufacturing costs of the known toner cartridge are thereby increased. Further, the disposition of the multiple projections as axial extensions of the toner cartridge may complicate alignment of the projections with the shutter of the image forming apparatus. Further, the axially extending projections may be prone to damage and breakage during shipping and/or during use of the known toner cartridge.

BRIEF SUMMARY OF THE INVENTION

It is an object of the invention to provide a developer cartridge for an image forming apparatus that avoids one or more of the disadvantages of the known toner cartridge.

The present invention provides a developer cartridge includes a body member configured to store a developer. The body member defines a developer delivery opening configured to deliver the stored developer to an exterior of the body member, the body member defining first and second open ends. A first flange member is disposed in the first open end. A second flange member is disposed in the second open end. A lug is aligned with an extension of the developer delivery opening. The lug is configured to open and to close a shutter of an image forming apparatus in which the developer cartridge is installed.

The present invention provides a developer cartridge including a projection configured to open and to close a shutter of an image forming apparatus in which the developer cartridge is installed, a first handle connected to the body member to cover the first flange, the first handle configured to permit rotation of the developer cartridge in the image forming apparatus, and a second handle configured to be connected to the first handle.

The present invention provides a developer cartridge including a stirring member disposed in the interior of the body member and configured to stir the stored developer and to deliver the developer to the exterior through the developer delivery opening. The stirring member includes a stirring member shaft about which the stirring member is configured to rotate. A first connection portion extends from the stirring member shaft in a first direction. A second connection portion extends from the first connection portion at an oblique angle. A developer delivery portion extends from the second connection portion, the developer delivery portion configured to deliver the developer to the exterior through the developer delivery opening.

The present invention still further provides a stirring member including a shaft member defining at least one void configured to permit developer flow through the shaft member. At least one stirring blade extends from the shaft member, the stirring blade configured to stir the developer in the body member and to deliver the developer to the exterior through the developer delivery opening. At least one auger member extends from the shaft member, the auger member configured to move the developer from the first open end of the body member toward a center of the body member.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION

Figure 1:
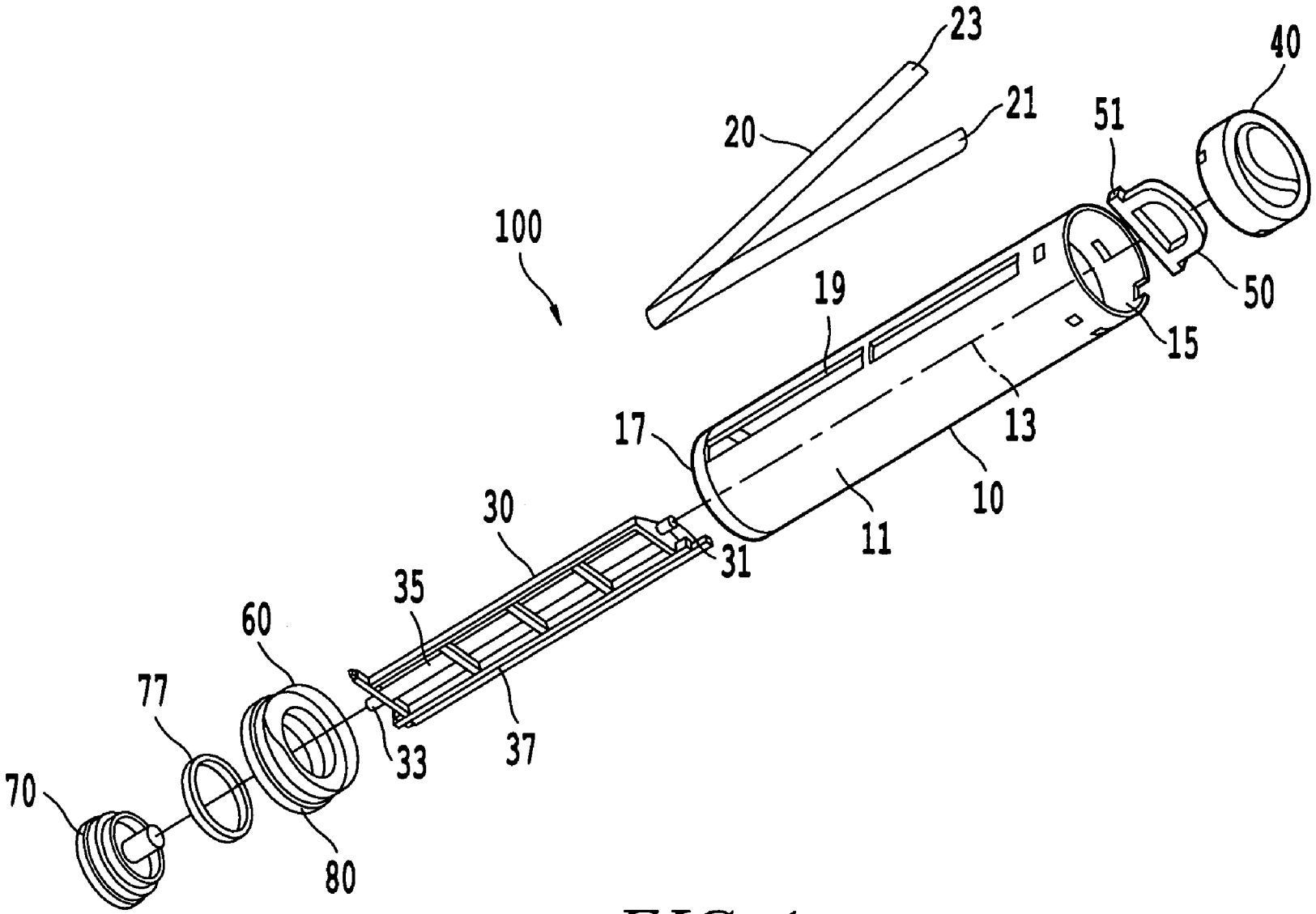
FIG. 1 shows an exploded isometric view of a developer cartridge according to the present invention.
Figure 2A:
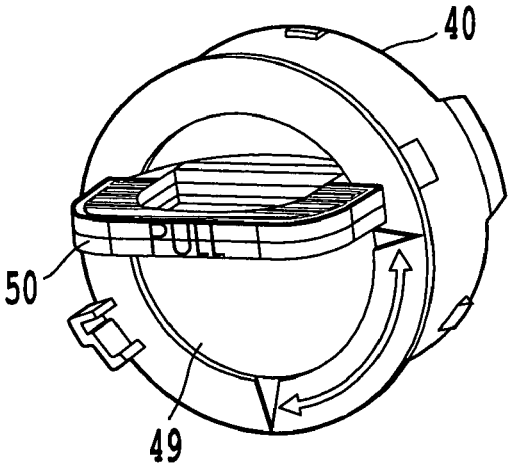
FIGS. 2A and 2B show detail isometric views of a first flange member and an extended and a retracted handle member of the developer cartridge of FIG. 1.
Figure 2B:
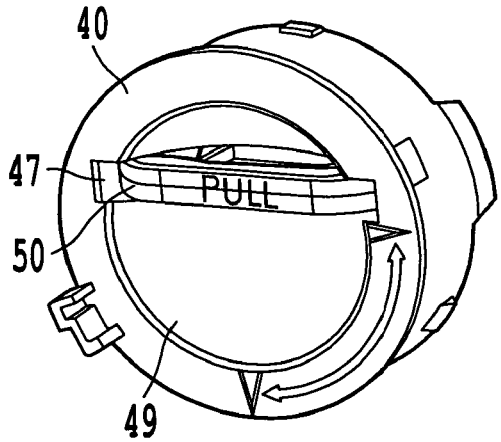
Figure 3:
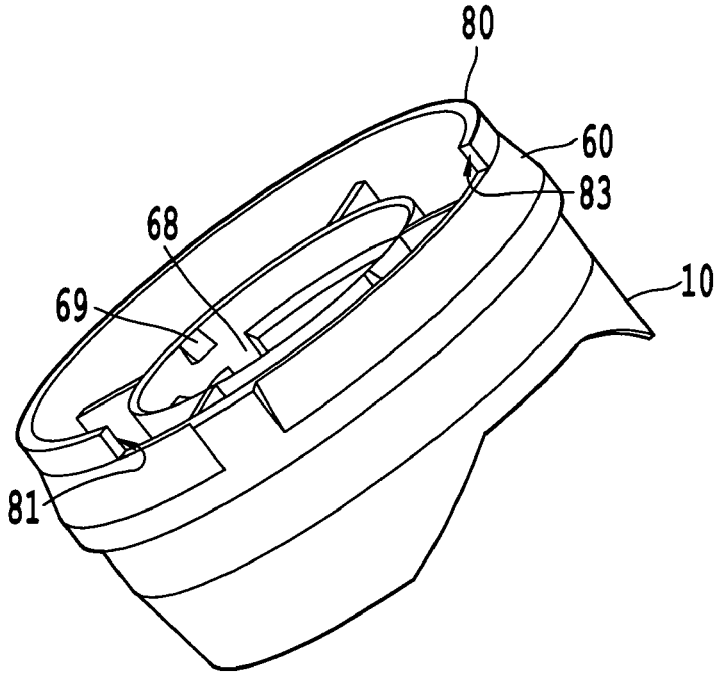
FIG. 3 shows a detail isometric view of a second flange member and a rim of the developer cartridge of FIG. 1.

Examples of preferred embodiments of the present invention will now be described with reference to the drawings, wherein like reference numbers throughout the several views identify like and/or similar elements.

The present invention is directed to a developer cartridge for an image forming apparatus. The developer cartridge of the present invention can include a rim configured to open and to close a shutter of the image forming apparatus. Thus, the developer cartridge of the present invention does not require multiple projections to open and to close the shutter.

In a preferred embodiment of the invention, as shown in the figures, a developer cartridge 100 can include a body member 10, a sealing member 20, a stirring member 30, a first flange member 40, a handle member 50, a second flange member 60, a drive hub and cap member 70, a gasketing member 77, and a rim 80 that can be configured to open and to close the shutter of the image forming apparatus. Although the drawings show preferred embodiments of the developer cartridge 100, it is to be understood that the developer cartridge 100 can include various structural elements or configurations, as long as the developer cartridge 100 can include the rim 80 to open and to close the shutter.

During installation in the image forming apparatus, the developer cartridge 100 can be rotated in a first direction, such that the rim 80 can contact and can displace a portion of the shutter of the image forming apparatus to thereby open the shutter. The developer cartridge 100 can be rotated in a second direction, which can be the same as or opposite to the first direction, such that the rim 80 can contact and can displace a portion of the shutter to thereby close the shutter.

As shown in the figures, the body member 10 can define an at least partially closed volume configured to store a developer (e.g., a single or multiple component toner) therein and to deliver the stored developer to the opening of the image forming apparatus. Although the drawings show preferred embodiments of the body member 10, it is to be understood that the body member 10 can have various arrangements, as long as the body member 10 can define the at least partially closed volume to store and to deliver the developer.

The body member 10 can include a sidewall 11 that extends along an axis 13. The sidewall 11 can define a first open ends 15 and a second open end 17 that is opposite to the first open end 15, as well as a developer delivery opening 19. The sidewall 11 can have a cross section that is one or more of a variety of shapes including, but not limited to, a circle, an ellipse, an oval, a polygon, or any combination of one or more of these shapes. In a preferred embodiment of the invention, the sidewall 11 can have a cross section that is circular in shape, such that the sidewall 11 can define a cylinder having a hollow interior portion.

Preferably, a longitudinal length of the sidewall 11 along the axis 13 can be between about 160 mm and about 400 mm, and more preferably can be between about 180 mm and about 330 mm, and still more preferably can be between about 200 mm and about 310 mm. Further, a radius of the hollow interior portion, and thus a radius of an interior face of the sidewall 11, can be between about 10 mm and about 70 mm, and more preferably can be between about 15 mm and about 35 mm, and still more preferably can be between about 25 mm and about 30 mm.

The first and second open ends 15, 17, can be disposed along the axis 13. In a preferred embodiment of the invention, either or both of the first and second open ends 15, 17, can have a cross section that is circular in shape. Portions of the sidewall 11 adjacent the first and second open ends 15, 17, can include openings to receive portions of the first and second flange members 40, 60, respectively.

A stirring member holding or receiving portion can be disposed adjacent the first open end 15. The stirring member holding or receiving portion can further close the at least partially closed volume. In a preferred embodiment of the invention, the stirring member holding and receiving portion can be in the form of a webbing defining a void to hold or receive an end of the stirring member 30.

The developer delivery opening 19 can be configured to deliver the stored developer in the developer cartridge 100 to the opening of the image forming apparatus. The developer delivery opening 19 can extend in any direction relative to the axis 13, can be spaced any distance or no distance from one or both of first and second open ends 15, 17, can have a cross section that is one or more of a variety of shapes including, but not limited to, a circle, an ellipse, an oval, a polygon, or any combination of one or more of these shapes, and can include a plurality of sub-openings, as long as the developer delivery opening 19 can deliver the stored developer to the opening of the image forming apparatus. In a preferred embodiment of the invention, the developer delivery opening 19 can extend along the axis 13, can be spaced from both the first and second open ends 15, 17, and can have two sub-openings with cross sections that are about rectangular in shape.

In a preferred embodiment of the invention, the body member 10 can be manufactured from materials including resin materials (e.g., ABS and/or polystyrene). Further, the body member 10 can be manufactured by processes including an injection molding process, an extrusion process, and/or a cooling core type process to size an interior portion of the body member 10. The developer delivery opening 19 and/or the openings adjacent the first and second open ends 15, 17, of the sidewall 11 can be formed by a material removal operation after manufacturing of the sidewall 11.

The sealing member 20 can prevent developer leakage from the at least partially closed volume through the developer delivery opening 19 prior to removal of the sealing member 20 from the body member 10. The sealing member 20 can be connected to the sidewall 11 of the body member 10 to cover the developer delivery opening 19. Although the drawings show preferred embodiments of the sealing member 20, it is to be understood that the sealing member 20 can be of various types, including that of a known or conventional type, as long as the sealing member 20 can prevent developer leakage through the developer delivery portion 19.

In a preferred embodiment of the invention, the sealing member 20 can be in the form of a flexible film. The sealing member 20 can have a length at least twice a length of the developer delivery opening 19.

A first portion 21 of the sealing member 20 can be connected to the body member 10 to cover the developer delivery opening 19. A second portion 23 of the sealing member 20 can be connected to the first portion 21, such that a force applied to the second portion 23 is transferred to the first portion 21 to thereby disconnect the sealing member 20 from the body member 10 and to uncover the developer delivery portion 19.

In a preferred embodiment of the invention, the first portion 21 can be connected to the body member 10 such that a force required to disconnect the first portion 21 from the body member 10 can be from about 0.5 kgf to about 7.0 kgf. Further, the first portion 21 can be connected to the body member 10 by manufacturing processes including hot plate fusing, impulse sealing, ultrasonic wave fusing, and/or high frequency fusing. The sealing member 20 can be manufactured from materials including, but not limited to, polyester resin, Nylon, polyethylene resin, and/or ethylene vinyl acetate. The sealing member 20 can have a thickness of between about 70 microns and about 200 microns, and more preferably between about 100 microns and about 150 microns, and still more preferably between about 108 and 122 microns.

The stirring member 30 can be configured to stir the stored developer in the body member 10 and to deliver the stored developer from the body member 10 through the developer delivery opening 19 to the opening of the image forming apparatus. Although the drawings show preferred embodiments of the stirring member 30, it is to be understood that the stirring member 30 can have any arrangement, including that of a known or conventional type, as long as the stirring member 30 can stir and deliver the developer to the opening of the image forming apparatus.

The stirring member 30 can include a first end 31 that can be disposed in the stirring member holding or receiving portion adjacent the first open end 15 and a second end 33 that can be driven by the drive hub and cap member 70 disposed in the second flange member 60, the second flange member 60 disposed in the second open end 17 of the body member 10. The first and second ends 31, 33, can be connected to a stirring member shaft 35, and the stirring member shaft 35 can be connected to one or more stirring blades 37. By this arrangement, rotation of the stirring member 30 can stir and deliver the developer. In a preferred embodiment of the invention, the first end 31 of the stirring member 30 can be disposed in the stirring member holding or receiving portion adjacent the first open end 15 prior to disposing the second flange member 60 and the drive hub and cap member 70 in the body member 10.

The first flange member 40 can be disposed in the first open end 15. The first flange member 40 can include voids and/or protrusions configured to cooperate with corresponding features of the sidewall 11, such as the opening adjacent the first open end 15, or alternatively can be formed during a formation (e.g., an injection molding) of the body member 10. Although the drawings show preferred embodiments of the first flange member 40, it is to be understood that the first flange member 40 can have various arrangements.

In a preferred embodiment of the invention, the first flange member 40 can be manufactured from materials including resin materials (e.g., ABS and/or polystyrene).

The first flange member 40 can include a handle member receiving opening 47 configured to receive the handle member 50. The handle member receiving opening 47 can be formed in the first flange member 40 during formation of the first flange member 40 (e.g., during an injection molding of the first flange member 40), and/or can be formed by a separate and subsequent material removal operation. In a preferred embodiment of the invention, the handle member receiving opening 47 can extend from a top face of the first flange member 40 to a bottom face of the first flange member 40, such that insertion of the handle member 50 into the handle member receiving opening 47 can be achieved from an interior of the developer cartridge 100 and/or from an interior of the first flange member 40. The handle member receiving opening 47 can be sized, shaped, and/or oriented so as to correspond with those aspects of the handle member 50, such that the handle member 50 can be extended and retracted.

The handle member 50 can be disposed in the handle member receiving opening 47, and can be configured to be used for rotation of the developer cartridge 100 in the image forming apparatus. The handle member 50 can be configured such that the handle member 50 can be moved in a direction about parallel to the axis 13, such that the handle member 50 can be extended for the rotation of the developer cartridge 100, and can be retracted. Thus, although the drawings show certain preferred embodiments of the handle member 50, it is to be understood that the handle member 50 can be of a variety of shapes and types, as long as the handle member 50 can be extended and retracted in the direction along the axis 13.

In a preferred embodiment of the invention, the handle member 50 can include handle member stops 51 configured to cooperate with portions of the first flange member 40 adjacent the handle member receiving opening 47, such that removal of the handle member 50 from the first flange member 40 without deformation (i.e., elastic and/or plastic) and/or breakage of the first flange member 40 and/or the handle member 50 can be prohibited. The first flange member 40 can include a recessed portion 49, such that extension and/or retraction of the handle member 50 can be facilitated. By this arrangement, the handle member 50 can be configured such that an outermost portion of the handle member 50 can be about flush with an outermost face of the first flange member 40 when the handle member 50 is retracted.

The second flange member 60 can be disposed in the second open end 17 of the body member 10 to further close the at least partially closed volume. The second flange member 60 can include voids and/or protrusions configured to cooperate with corresponding features of the sidewall 11, such as the opening adjacent the second open end 17. Although the drawings show preferred embodiments of the second flange member 60, it is to be understood that the second flange member 60 can have various arrangements, including that of a known or conventional type, as long as the second flange member 60 can further close the at least partially closed volume.

The second flange member 60 can include a stirring member holding or receiving portion that can define a stirring member bore. The stirring member holding or receiving portion can be configured to support the stirring member 30, such that the second end 33 of the stirring member 30 can be disposed in the stirring member bore.

The second flange member 60 can define a developer receiving opening 68 configured to receive the developer from an outside developer source (e.g., a bulk developer source, such as a toner bottle) for storage in the developer cartridge 100. The developer receiving opening 68 can have a cross section that is in one or more of a variety of shapes including, but not limited to, a circle, an ellipse, an oval, a polygon, or any combination of one or more of these shapes, and can be disposed at any position on the second flange member 60. In a preferred embodiment of the invention, the developer receiving opening 68 can have a cross section that is about circular in shape, and can be disposed at a center of the second flange member 60.

In a preferred embodiment of the invention, a cross sectional area of the developer receiving opening 68 can be between about 70% and 60% of the cross sectional area of the second open end 17, and still more preferably can be about 62.4% of the cross sectional area of the second open end 17. Further, one or both of the developer receiving opening 68 and the stirring member holding or receiving portion of the second flange 60 can be disposed such that receipt of the developer through the developer receiving opening 68 can be satisfactorily accomplished.

In a preferred embodiment of the invention, the second flange member 60 can be manufactured from materials including resin materials (e.g., ABS and/or polystyrene). The second flange member 60 can be manufactured by processes including an injection molding process.

The drive hub and cap member 70 can be configured to be disposed in the developer receiving opening 68 of the second flange member 60, such that leakage of the developer through the developer receiving opening 68 can be prevented, and such that driving of the stirring member 30 can be accomplished through driving of the second end 33. Although the drawings show certain preferred embodiments of the drive hub and cap member 70, it is to be understood that the drive hub and cap member 70 can be of various types, as long as the drive hub and cap member 70 can be disposed in the developer receiving opening 68 to prevent leakage of the developer.

In a preferred embodiment of the invention, the drive hub and cap member 70 can be non-removably retained in the developer receiving opening 68. In this context, non-removably retained can be defined to include that attempted and/or successful removal of the drive hub and cap member 70 can result in damage to at least some portion of the developer cartridge 100. Examples of damage to the developer cartridge 100 can include elastic deformation, plastic deformation, and/or breakage of a portion of the sidewall 11, the second flange member 60, and/or the drive hub and cap member 70. In a preferred embodiment of the invention, methods for preventing removal of the drive hub and cap member 70 from the developer receiving opening 68 can include, but are not limited to, achievement of an interference fit therebetween and/or mechanical fastening techniques (e.g., adhesion). Preferably, the interference fit can be achieved by disposing at least a portion of a side wall of the drive hub and cap member 70 below a locking tab 69 of the second flange member 60, and more preferably by disposing the side wall of the drive hub and cap member 70 below two locking tabs 69.

The drive hub and cap member 70 can be manufactured from materials including low and/or high density polyethylene, and/or polypropylene.

A gasketing member 77 can be disposed between the developer receiving opening 68 of the second flange member 60 and a portion of the drive hub and cap member 70, and can prevent a leakage of developer therebetween. Optionally, the gasketing member 77 can be omitted from the developer cartridge 100.

The rim 80 can be configured to open and to close the shutter of the image forming apparatus, such that the developer stored in the developer cartridge 100 can be delivered to the image forming apparatus. In a preferred embodiment of the invention, the developer cartridge 100 can be inserted into the image forming apparatus. The developer cartridge 100 can be rotated (e.g., manually) such that the rim 80 can contact and can displaces a corresponding portion of the shutter to thereby open the shutter. The developer cartridge 100 can be rotated (e.g., manually) in a second direction (e.g., either opposite to or in a same direction as the first direction), such that the rim 80 can contact and can displace a corresponding portion of the shutter (e.g., a same portion or a different portion as contacted during the opening of the shutter) to thereby close the shutter. Although the drawings show preferred embodiments of the rim 80, it is to be understood that the rim 80 can have any arrangement, as long as the rim 80 can open and can close the shutter of the image forming apparatus.

The rim 80 can be disposed on the second flange member 60. In a preferred embodiment of the invention, the rim 80 can be formed by an extension of a periphery of the second flange member 60, and can be formed during a manufacture of the second flange member 60. As shown in the drawings, the rim can include first and second faces 81, 83, each configured to perform one of the opening and the closing of the shutter. Preferably, the rim 80 can be formed as an extension of an outer circumference of the second flange member 60, and can encompass an arc of at least about 180 degrees between the first and second faces 81, 83, and more preferably can encompass an arc of about 245 degrees between the first and second faces 81, 83. In a preferred embodiment of the invention, that can be used with a known image forming apparatus, the first face 81 can be used to close the shutter of the known image forming apparatus, and the second face 83 can be used to open the shutter.

Further, the rim 80 can be in various forms. For example, the rim 80 can have a single or multiple thicknesses along an arcuate portion. One or both of the first and second faces 81, 83, can extend towards and/or away from the axis 13.

Alternative locations for the rim 80 can include, but are not limited to, a variety of positions on the first flange member 40 and the drive hub and cap member 70. Further, the rim 80 can be disposed at any position on the second flange member 60. Additionally, the first and second faces 81, 83, can be disposed at any position on, and/or in any orientation relative to, the rim 80.

The rim 80 can be produced by various manufacturing processes, including extrusion of a full peripheral portion and/or as part of an injection molded component, and subsequent material removal to form the first and second faces 81, 83, or alternatively extrusion of a periphery and the first and second faces 81, 83 (e.g., without subsequent material removal). Production of the rim 80 can be simplified as compared to the manufacture of multiple projections on a known toner cartridge, as a more complicated manufacturing process, tooling, and/or mold may be required for the known toner cartridge.

Further, the disposition of the rim 80 on an end portion (i.e., as a radial extension) of the developer cartridge 100 can provide numerous advantages, such as a more positive alignment and/or engagement with the shutter of the image forming apparatus. Further, the radially extending rim 80 can be less susceptible to breakage during shipping and/or during use of the developer cartridge 100.

Figure 4:
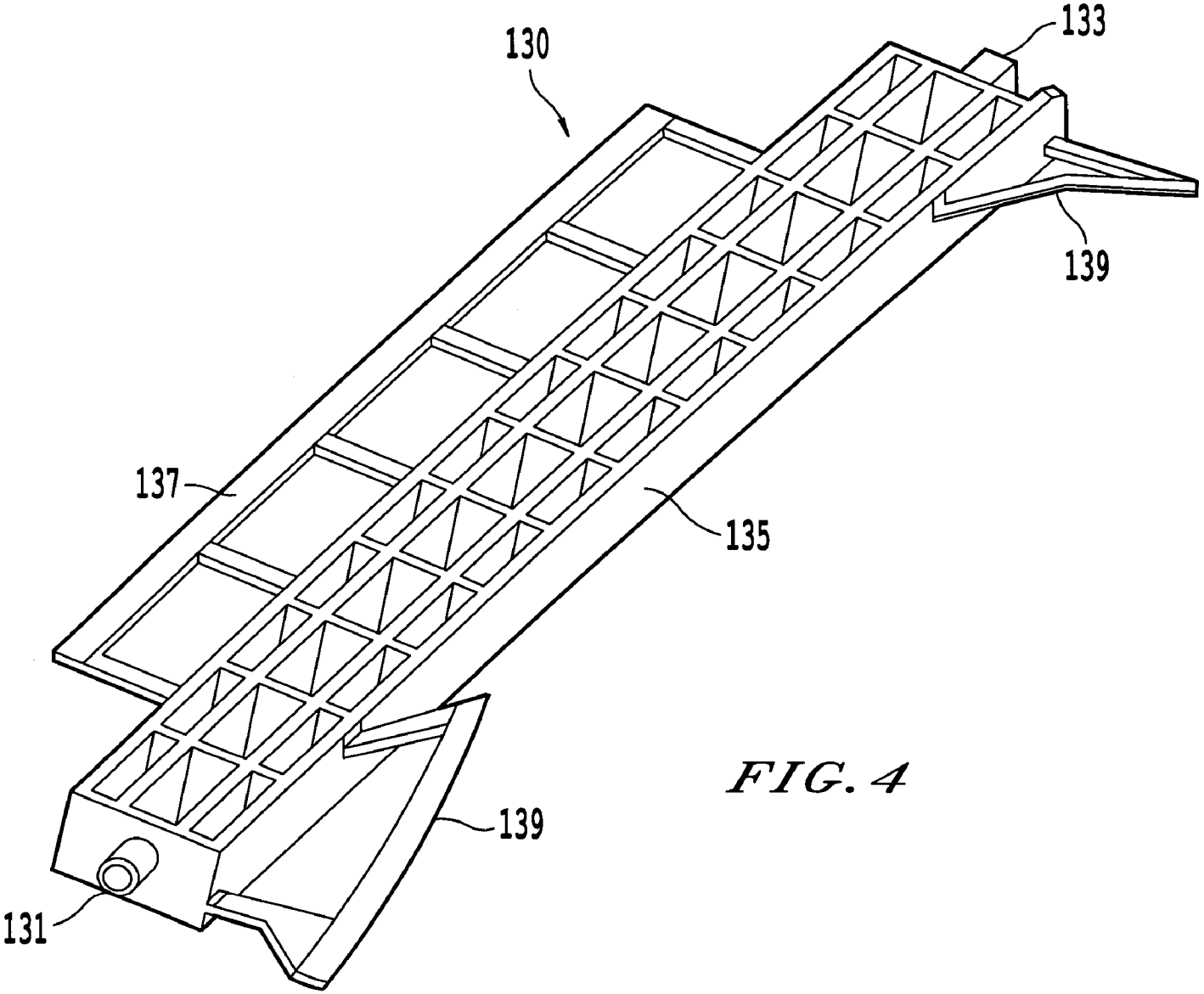
FIG. 4 shows a top isometric top view of a stirring member.
Figure 5:
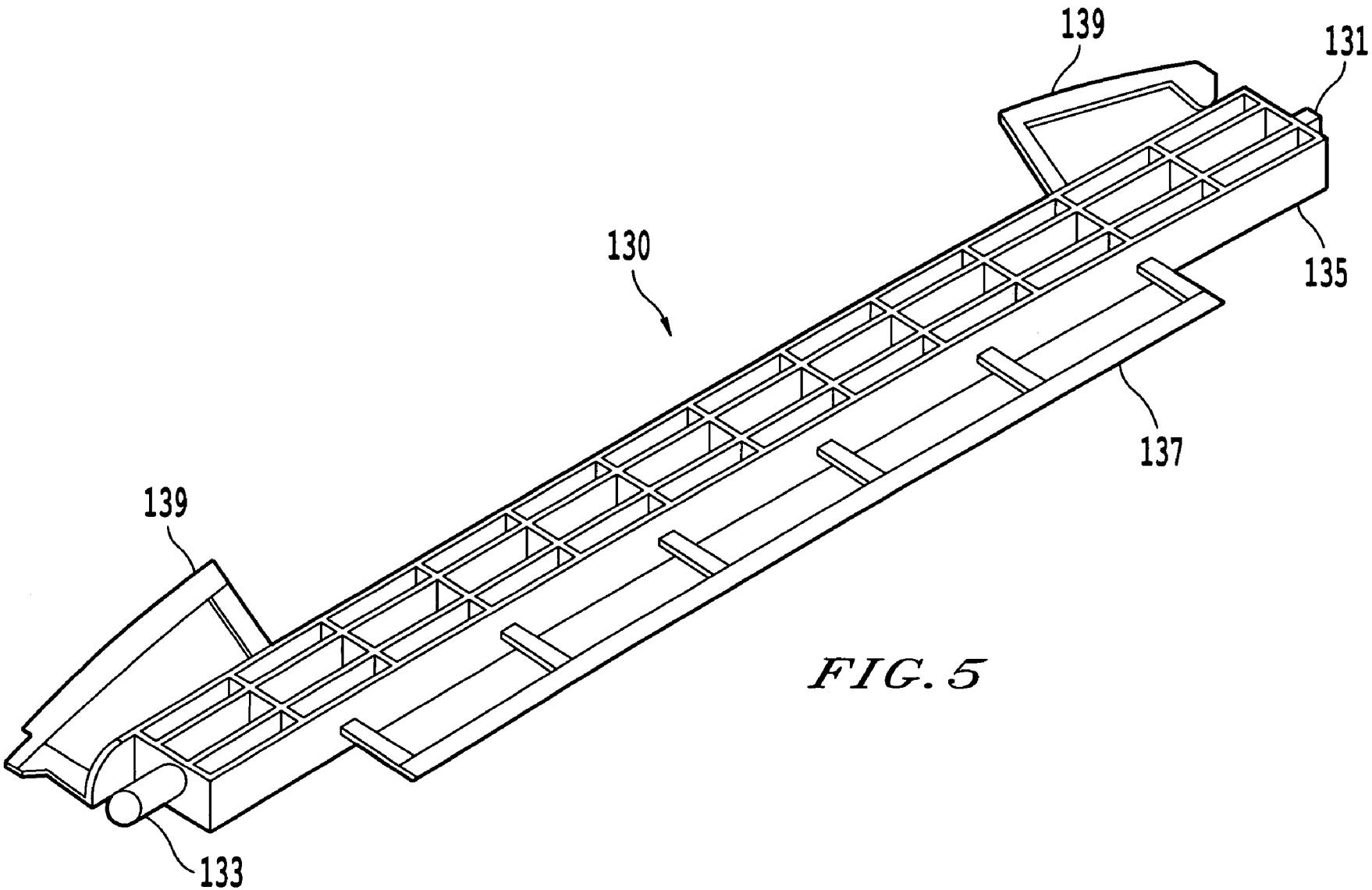
FIG. 5 shows a bottom isometric view of the stirring member of FIG. 4.
Figure 6:
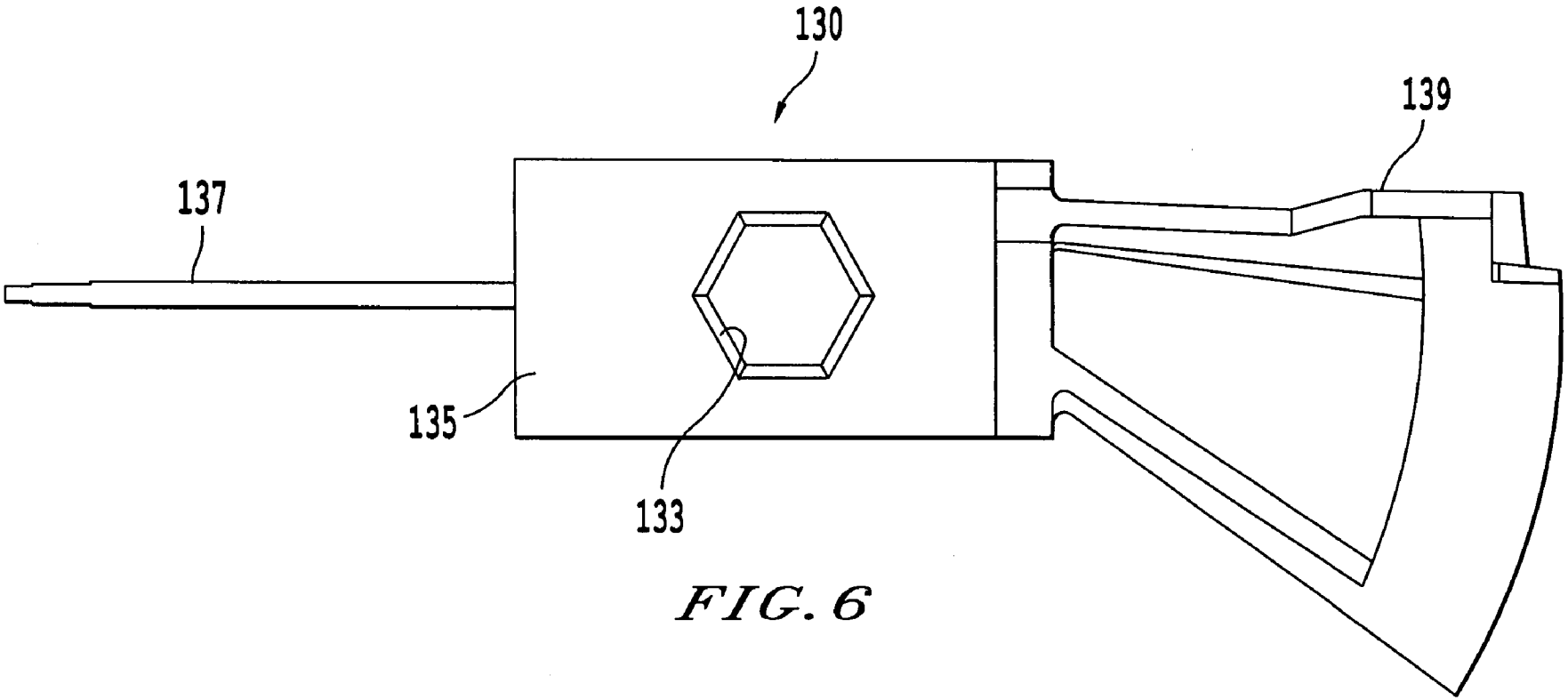
FIG. 6 shows a side view of the stirring member of FIG. 4.
Figure 7:
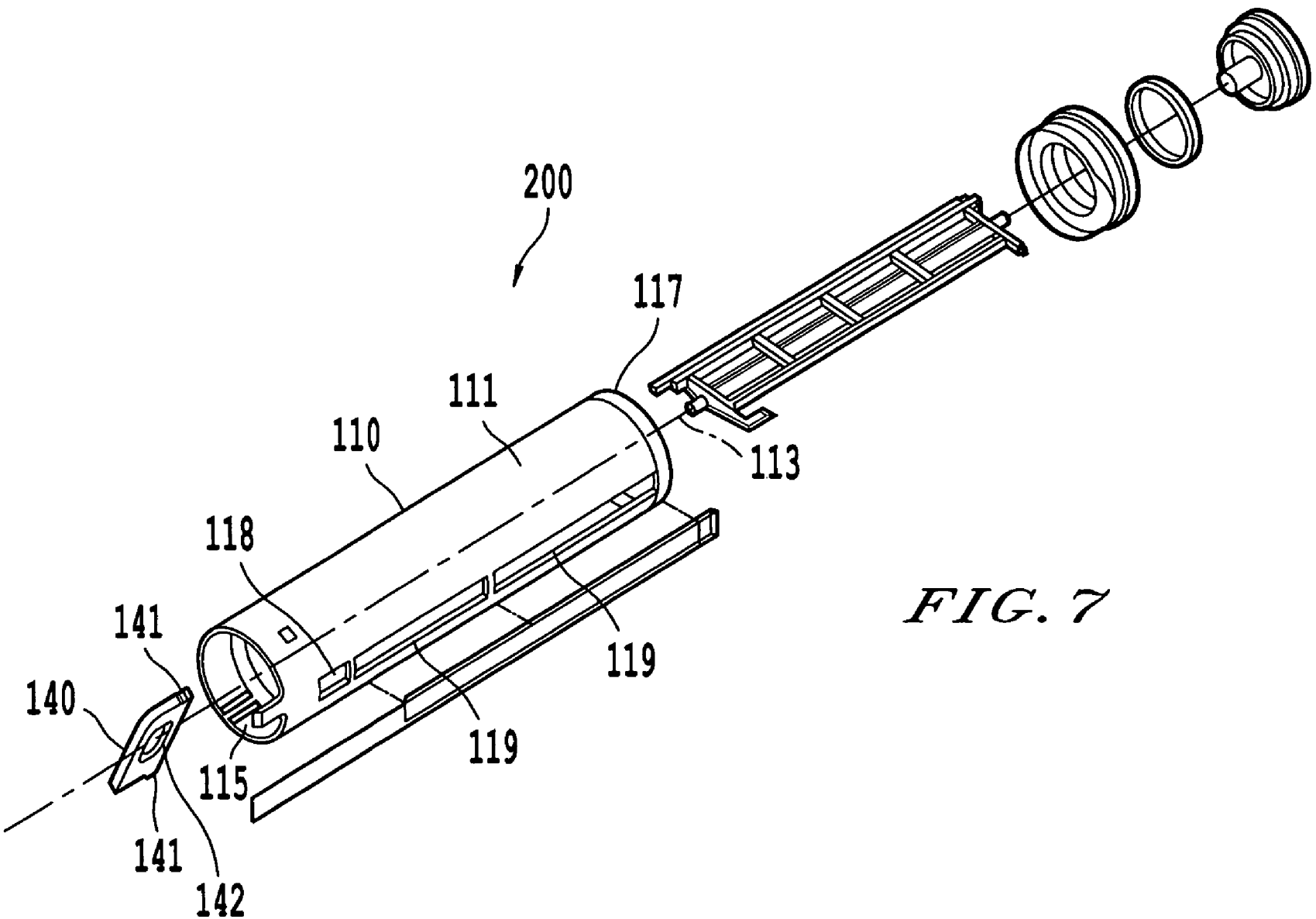
FIG. 7 shows an exploded isometric view of a developer cartridge including a body member according to an embodiment of the invention.

FIGS. 4-6 show a stirring member 130 that can be configured to stir developer stored in a body member (e.g., the body member 10) of a developer cartridge (e.g., the developer cartridge 100), and to deliver the stored developer from the body member through a developer delivery opening (e.g., the developer delivery opening 19) to an opening of an image forming apparatus.

The stirring member 130 can include a first end 131 that can be disposed in a stirring member holding or receiving portion adjacent a first open end of the body member (e.g., the first open end 15) and a second end 133 that can be driven by a drive hub and cap member (e.g., the drive hub and cap member 70) disposed in a second flange member (e.g., the second flange member 60), the second flange member disposed in a second open end (e.g., the second open end 17) of the body member. In a preferred embodiment of the invention, the first end 131 of the stirring member 130 can be disposed in the stirring member holding or receiving portion adjacent the first open end prior to disposing the second flange member and the drive hub and cap member in the body member.

The first and second ends 131, 133, can be connected to a stirring member shaft 135. In a preferred embodiment, the stirring member shaft 135 can have a lattice-type or open-box type structure defining voids having opposing open sides. By this arrangement, the developer can pass through the voids in the stirring member shaft 135 when the stirring member shaft 135 stirs and delivers the developer.

One or more stirring blades 137 can be disposed on a first side of the stirring member shaft 135 to stir and/or to deliver the developer stored in the body member through the developer delivery opening. In a preferred embodiment of the invention, one stirring blade 137 can be disposed on the stirring member shaft 135, and the stirring blade 137 can be sized and shaped such that the stirring blade 137 does not contact an interior of the body member and/or does not deform or deflect as a result of contact with the interior during rotation of the stirring member 130.

One or more auger blades 139 can be disposed on a second side of the stirring member shaft 135 to direct the developer stored in the body member in a direction along the axis of rotation of the stirring member 130. In a preferred embodiment of the invention, two auger blades 139 can be disposed on opposite ends of the stirring member shaft 135, and the two auger blades 139 can be sized and shaped such that one or both of the auger blades 139 does not contact the interior of the body member and/or does not deform or deflect as a result of contact with the interior during rotation of the stirring member 130. In the preferred embodiment, the auger blades 139 can be disposed such that during rotation of the stirring member 130, the auger blades 139 can direct the developer stored in the body member along the axis of the rotation of the stirring member 130 in directions opposite to one another and toward a center of the axis of rotation and/or the stirring member shaft 135. The developer axially directed by the auger blades 139 can be delivered through the developer delivery opening of the body member by the stirring blade 137.

FIGS. 7-11 show a developer cartridge 200 that can include a variety of components (e.g., including one or more of the components of the developer cartridge 100).

The developer cartridge 200 can include a body member 110 defining an at least partially closed volume configured to store a developer (e.g., a single or multiple component toner) therein and to deliver the stored developer to an opening of an image forming apparatus.

The body member 110 can include a sidewall 111 that extends along an axis 113. The sidewall 111 can define a first open ends 115 and a second open end 117 that is opposite to the first open end 115, as well as a developer delivery opening 119. The sidewall 111 can have a cross section that is one or more of a variety of shapes including, but not limited to, a circle, an ellipse, an oval, a polygon, or any combination of one or more of these shapes. In a preferred embodiment of the invention, the sidewall 111 can have a cross section that is circular in shape, such that the sidewall 111 can define a cylinder having a hollow interior portion.

The first and second open ends 115, 117, can be disposed along the axis 113. In a preferred embodiment of the invention, either or both of the first and second open ends 115, 117, can have a cross section that is circular in shape. Portions of the sidewall 111 adjacent the first and second open ends 115, 117, can include openings to receive portions of the first and second flange members (e.g., the first and second flanges 40 and 60), respectively.

A stirring member holding or receiving portion can be disposed adjacent the first open end 115. The stirring member holding or receiving portion can further close the at least partially closed volume. In a preferred embodiment of the invention, the stirring member holding and receiving portion can be in the form of a webbing defining a void to hold or receive an end of a stirring member (e.g. the stirring member 30, and/or the stirring member 130).

The developer delivery opening 119 can be configured to deliver the stored developer in the developer cartridge 200 to the opening of the image forming apparatus. The developer delivery opening 119 can extend in any direction relative to the axis 113, can be spaced any distance or no distance from one or both of first and second open ends 115, 117, can have a cross section that is one or more of a variety of shapes including, but not limited to, a circle, an ellipse, an oval, a polygon, or any combination of one or more of these shapes, and can include a plurality of sub-openings, as long as the developer delivery opening 119 can deliver the stored developer to the opening of the image forming apparatus. In a preferred embodiment of the invention, the developer delivery opening 119 can extend along the axis 113, can be spaced from both the first and second open ends 115, 117, and can have two sub-openings with cross sections that are about rectangular in shape.

An exterior of the body member 110 can include one or more lugs 118 disposed thereon. The one or more lugs 118 can be used to aid in an opening and/or a closing operation of a shutter covering the opening of the image forming device to which the developer in the body member 110 is to be delivered. In a preferred embodiment of the invention, the body member 110 includes one or two lugs 118 disposed at ends of a developer delivery opening 119, the developer delivery opening formed by one or more sub-openings. In a more preferred embodiment, the one or more lugs 118 can be disposed entirely within a boundary of the developer delivery opening 119 (that is, the one or more lugs 118 do not project outside of the rectangular shape defined by the opening, or in other words, the lug or lugs are aligned with the opening).

Figure 8:
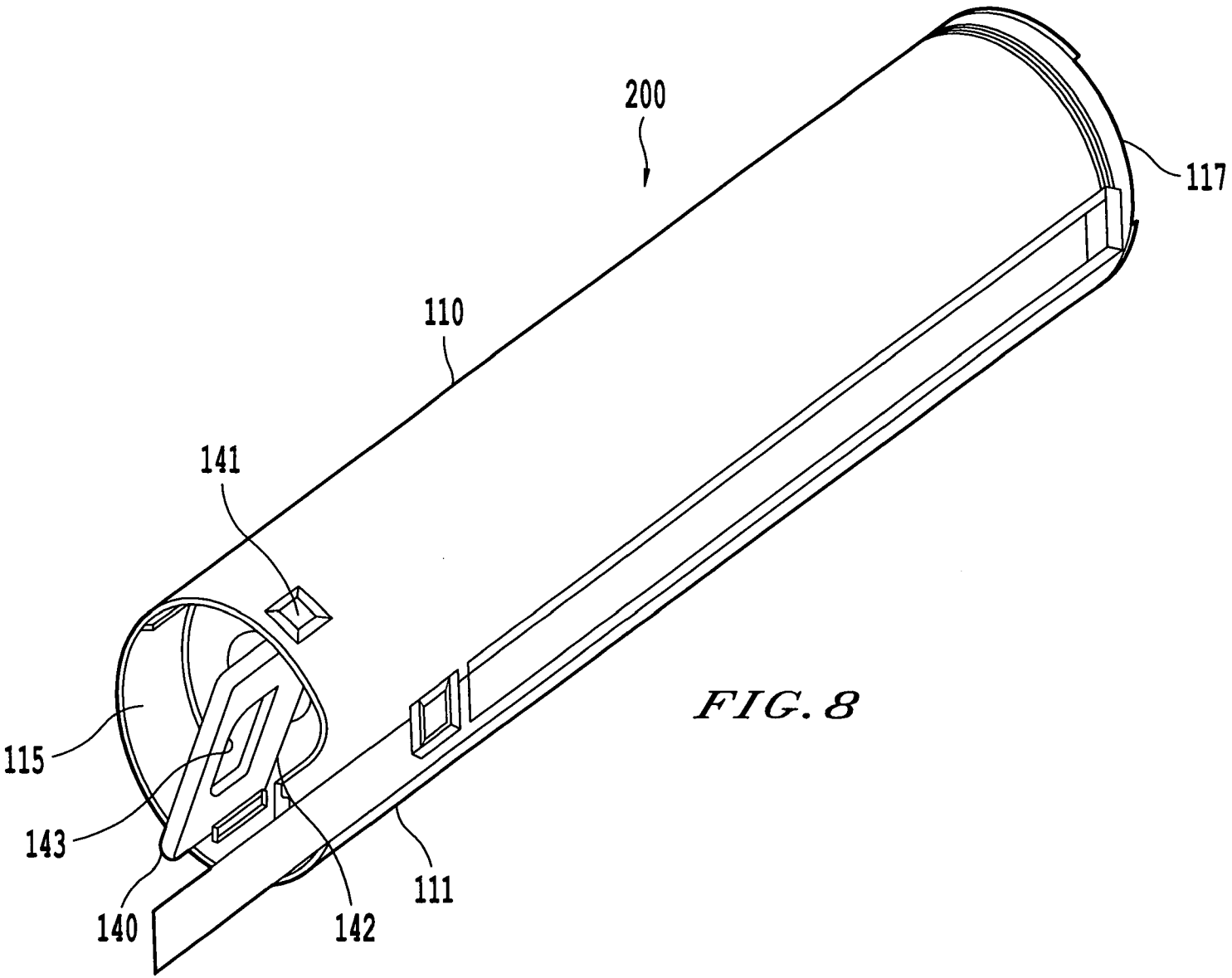
FIG. 8 shows a side isometric view of the developer cartridge of FIG. 7.
Figure 9A:
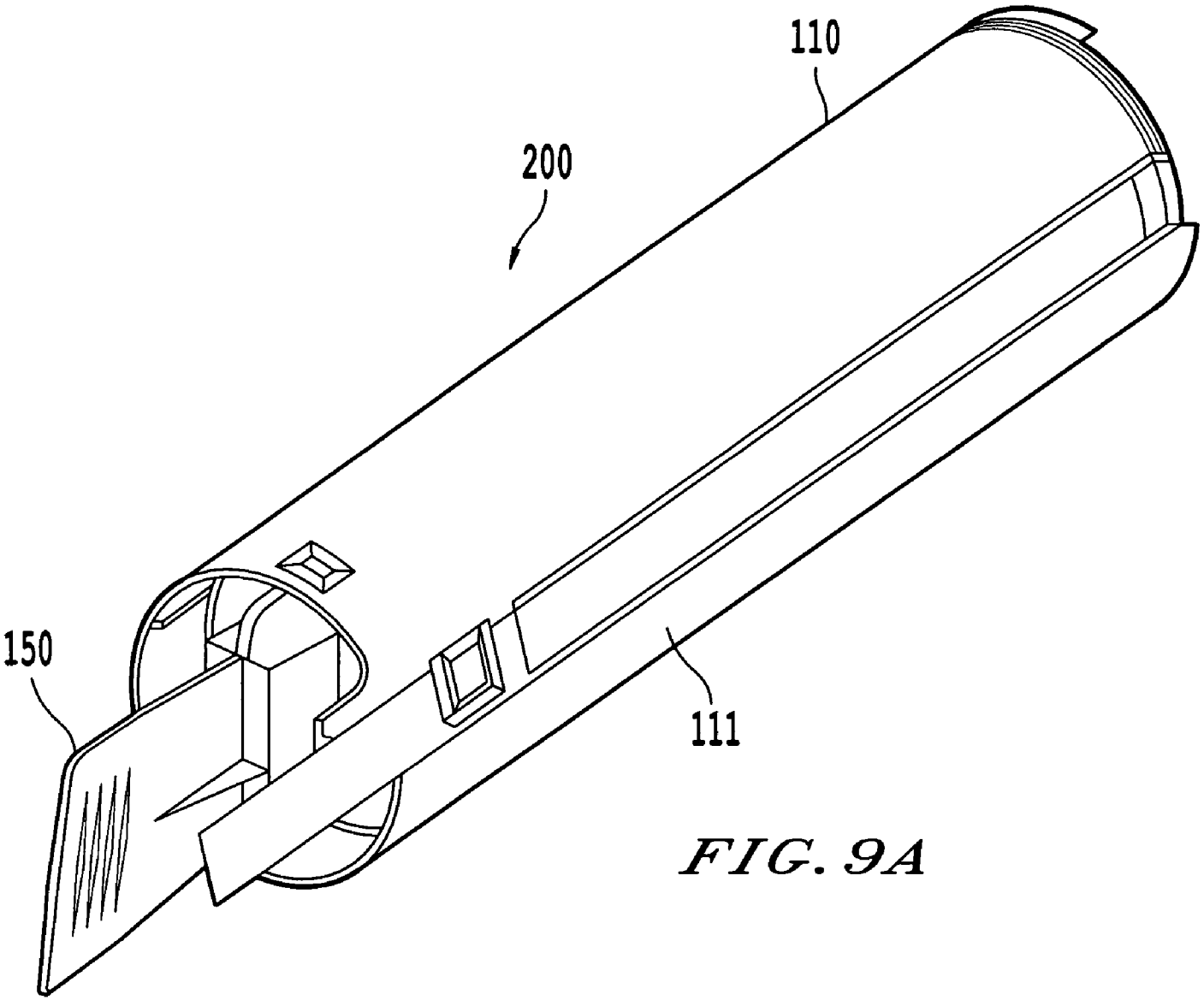
FIG. 9A shows a side isometric view of the developer cartridge of FIG. 7 including a handle extension.
Figure 9B:
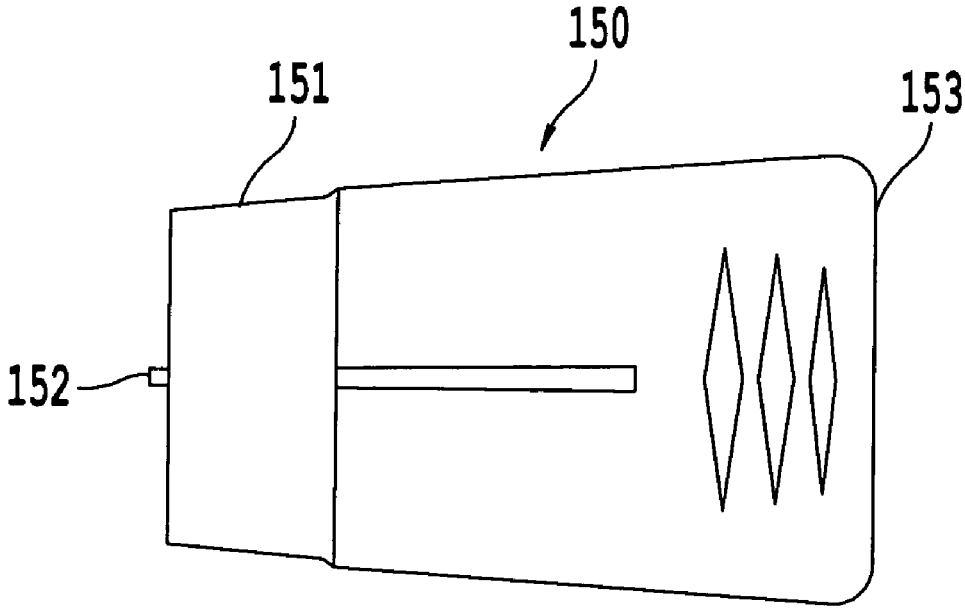
FIG. 9B shows a top view of the handle extension of FIG. 9A.
Figure 9C:
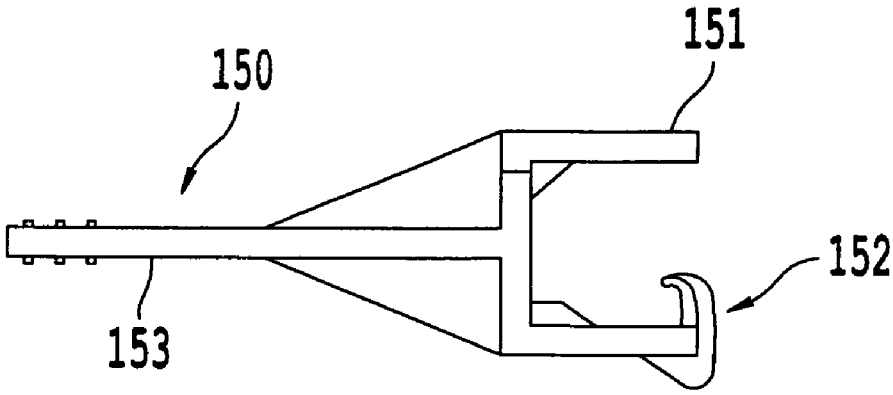
FIG. 9C shows a side view of the handle extension of FIG. 9A.
Figure 10:
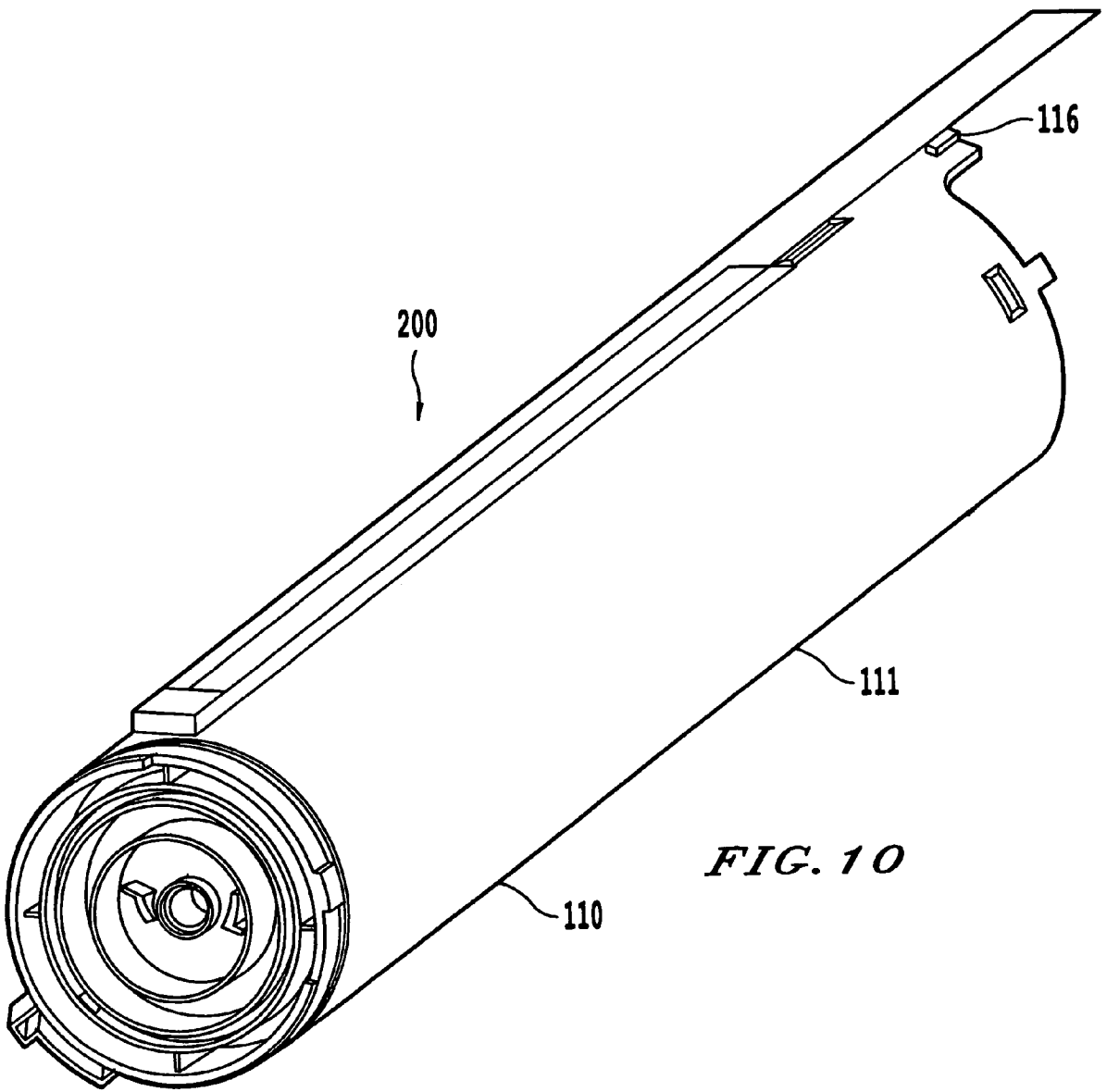
FIG. 10 shows a top isometric view of the developer cartridge of FIG. 7.
Figure 11:
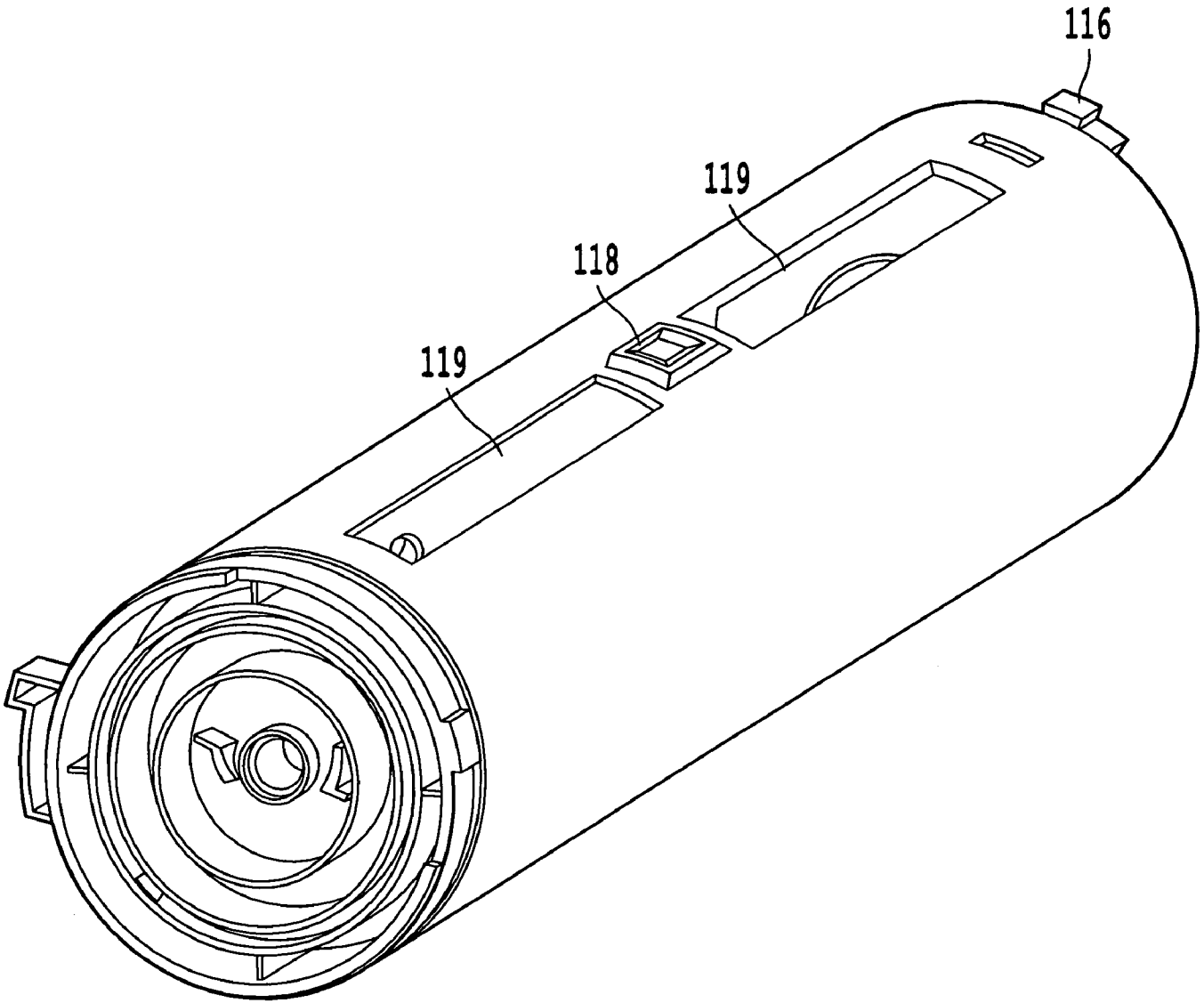
FIG. 11 shows a top isometric view of another embodiment of the developer cartridge.

In a preferred embodiment of the invention shown in FIGS. 8-10, a single lug 118 is disposed adjacent an end of the developer delivery opening 119. In a preferred embodiment of the invention shown in FIG. 11, a single lug 118 is disposed between two sub-openings of the developer delivery opening 119. It is to be understood that the one or more lugs 118 can include a plurality of lugs, and/or that the one or more lugs 118 can be disposed at a variety of positions on the exterior of the body member 110.

The exterior of the body member 110 can include one or more projections 116 configured to indicate the presence and/or installation of the developer cartridge 200 in the image forming apparatus, the image forming apparatus including one or more sensors to sense the presence of the projections 116. It is to be understood that the projections 116 can be disposed at a variety of positions on the body member 110, can be of a variety of shapes, and/or can be omitted from the body member 110.

In a preferred embodiment of the invention, the body member 110 can be manufactured from materials including resin materials (e.g., ABS and/or polystyrene). Further, the body member 110 can be manufactured by processes including an injection molding process, an extrusion process, and/or a cooling core type process to size an interior portion of the body member 110. The developer delivery opening 119 and/or the openings adjacent the first and second open ends 115, 117, of the sidewall 111 can be formed by a material removal operation after manufacturing of the sidewall 111.

The figures also show a supplemental handle member 150 can be used with various developer cartridges (e.g., the developer cartridge 200 disclosed herein or the developer cartridge 100). The handle member 150 can be used to increase an effective length of a handle member of a developer cartridge (e.g., the handle member 50). By this arrangement, an installation in and/or a removal from the image forming apparatus of the developer cartridge including the supplemental handle member 150 can be accomplished more comfortably by users having various hand sizes. In a preferred embodiment of the invention, the handle member 150 can be removably disposed on the handle member of the developer cartridge.

Specifically, the developer cartridge can include a first handle 140 covering the flange that closes the end of the body portion of the developer cartridge. The first handle 140 can include first and second protrusions 141 extending from a base portion 142 of the first handle 140. The first handle 140 can be aligned with channels formed in the developer cartridge, such that the first handle 140 is captured by the channels. The first and second protrusions 141 can be disposed in cooperating voids formed in the developer cartridge. By this arrangement, the first handle 140 can be prevented from being removed from the developer cartridge, without damage to one of the first handle 140 and the developer cartridge itself. The first handle 140 can also define a first handle opening 143. Thus, the developer cartridge can be rotated, such as to install the developer cartridge in an image forming apparatus, to open and close a shutter of the image forming apparatus, and the like, through rotation of the first handle 140. Preferable, a user manually rotates the developer cartridge by placing his fingers around the first handle 140 and through the first handle opening 143.

The first handle 140 can be sized and shaped such that a significant length, and more preferably such that a majority (i.e., more than half) of the length can be disposed within the end of the body portion of the developer cartridge. Thus, the first handle 140 can have a relatively compact arrangement in the developer cartridge.

The supplemental handle member or second handle 150 can be connected to the first handle 140. The second handle 150 can include an attachment portion 151, preferable having an about L-shape and more preferable having an about U-shape, with a projection 152 configured to be removably connected with the first handle 140, and a grip portion 153, preferable in the form of an about flat plate.

The projection 152 can be received in the first handle opening 143 of the first handle, and the attachment portion 151 can surround a portion of the first handle 140. By this arrangement, plastic or elastic deformation of the attachment portion 151 can permit attachment and/or removal of the second handle 150 to the first handle 140, such that rotation of the second handle 150 results in rotation of the first handle 140 and subsequent rotation of the developer cartridge. In a preferred embodiment, the projection 152 can have an about hook shape, such that unintended release of the second handle 150 from the first handle 140 is minimized.

The second handle 150 can include one or more strengthening ribs to strengthen the grip portion 153, the attachment portion 151, and/or an interface therebetween.

Figure 12:
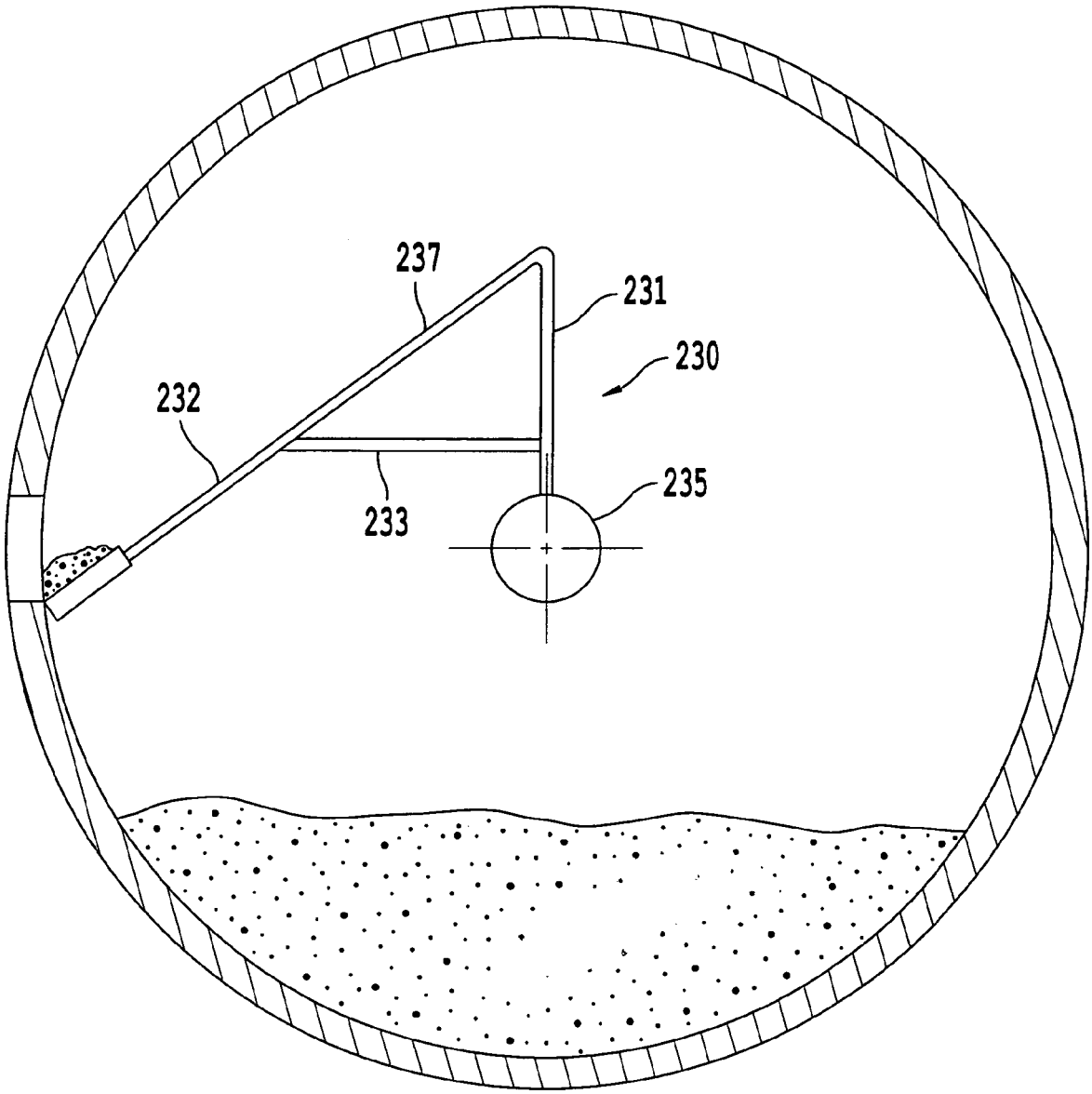
FIG. 12 shows a cross-sectional view of a developer cartridge including a stirring member according to another embodiment of the invention.

FIG. 12 show another embodiment of a stirring member 230 that can be configured to stir developer stored in a body member (e.g., the body member 10, and/or the body member 110) of a developer cartridge (e.g., the developer cartridge 100, and/or the developer cartridge 200), and to deliver the stored developer from the body member through a developer delivery opening (e.g., the developer delivery opening 19, and/or the developer delivery opening 119) to an opening of an image forming apparatus.

The stirring member 230 can include first and second ends connected to a stirring member shaft 235. One or more stirring blades 237 can be disposed on the stirring member shaft 235 to stir and/or to deliver the developer stored in the body member through the developer delivery opening. The stirring blade 237 can include a connecting portion 231 connected to the stirring member shaft 235, a delivery portion 232 connected to the connecting portion 231, and a support portion 233 disposed between the connecting portion 231 and the delivery portion 232. The connecting portion 231 can extend from the stirring member shaft 235, and the delivery portion 232 can extend at an angle from the connecting portion 231. By this arrangement, the delivery portion 232 can be disposed such that the developer flows or slides from the delivery portion 232 through the developer delivery opening of the developer cartridge. The support portion 233 can prevent undesired deformation and/or relative movement of the connecting portion 231 and the delivery portion 232.

In a preferred embodiment of the invention, one stirring blade 237 can be disposed on the stirring member shaft 235, and the stirring blade 237 can be sized and shaped such that the stirring blade 237 does not contact an interior of the body member and/or does not deform or deflect as a result of contact with the interior during rotation of the stirring member 230.

Numerous additional modifications and variations of the present invention are possible in light of the above teachings. It is therefore to be understood that within the scope of the appended claims, the present invention may be practiced otherwise than as specifically described herein.

The invention claimed is:

1. A developer cartridge, comprising:

a body member configured to store a developer, the body member defining a developer delivery opening configured to deliver the stored developer to an exterior of the body member, the body member defining first and second open ends;

a first flange member disposed in the first open end;

a second flange member disposed in the second open end;

a lug aligned with an extension of the developer delivery opening, the lug configured to open and to close a shutter of an image forming apparatus in which the developer cartridge is installed;

wherein the developer delivery opening comprises first and second openings aligned with one another, and the lug is aligned with the first and second delivery openings; and wherein the lug is disposed between the first and second openings.

2. The developer cartridge according to claim 1, wherein the lug comprises first and second lugs, and at least one of the first and second lugs is aligned with the developer delivery opening.

3. A developer cartridge, comprising:

a body member configured to store a developer, the body member defining a developer delivery opening configured to deliver the stored developer to an exterior of the body member, the body member defining first and second open ends;

a first flange member disposed in the first open end;

a second flange member disposed in the second open end;

a projection configured to open and to close a shutter of an image forming apparatus in which the developer cartridge is installed;

a first handle connected to the body member to cover the first flange, the first handle configured to permit rotation of the developer cartridge in the image forming apparatus; and a second handle configured to be connected to the first handle.

4. The developer cartridge according to claim 3, wherein the second handle comprises a protrusion configured to be disposed in an opening of the first handle.

5. The developer cartridge according to claim 4, wherein the second handle comprises an attachment portion including the protrusion, and comprises a grip portion connected to the attachment portion.

6. The developer cartridge according to claim 5, wherein the grip portion comprises an about flat plate, and the attachment portion comprises an about L-shaped portion from which the protrusion extends.

7. The developer cartridge according to claim 6, wherein the attachment portion comprises an about U-shaped portion configured to surround the first handle.

8. The developer cartridge according to claim 7, wherein the protrusion extends from an end of the about U-shaped portion.

9. The developer cartridge according to claim 8, wherein at least one of the flat plate and the U-shaped portion comprises a strengthening rib.

10. The developer cartridge according to claim 9, wherein the strengthening rib extends between an interface of the flat plate and the about U-shaped portion.

11. The developer cartridge according to claim 3, wherein the first handle is irremovable connected to the body member.

12. The developer cartridge according to claim 3, wherein the first handle comprises a projection configured to be disposed in a corresponding void formed in the body member.

13. The developer cartridge according to claim 12, wherein the first handle comprises a pair of projections configured to be disposed in a pair of corresponding voids in the body member.

14. The developer cartridge according to claim 13, wherein the first handle has a length along a longitudinal axis of the body member, and a majority of the length is disposed within the body member.

15. The developer cartridge according to claim 14, wherein the first handle is disposed in at least one corresponding channel formed in the first end of the body member.

* * * * *